United States Patent [19]

Commers

[11] 4,429,631

[45] Feb. 7, 1984

[54] AUXILIARY INKING ROLLER KIT FOR DUPLICATING PRESS

[75] Inventor: Louis P. Commers, Melrose Park, Ill.

[73] Assignee: Suburban Duplicator Repair, Inc., Franklin Park, Ill.

[21] Appl. No.: 417,144

[22] Filed: Sep. 13, 1982

[51] Int. Cl.[3] ..... B41F 31/00

[52] U.S. Cl. ..... 101/349; 101/352

[58] Field of Search ..... 101/348, 349, 350, 351, 101/352, 148, 113

[56] References Cited

U.S. PATENT DOCUMENTS

| | | | |
|---|---|---|---|
| 1,127,811 | 2/1915 | Sabot | 101/348 |
| 1,139,710 | 5/1915 | Ocumpaugh | 101/352 |
| 2,083,497 | 6/1937 | Dix | 101/351 |
| 2,314,351 | 3/1943 | Harrold | 101/351 X |
| 3,259,060 | 7/1966 | Martin | 101/348 |
| 3,440,958 | 4/1969 | Benda et al. | 101/349 |
| 3,491,686 | 1/1970 | Zurick | 101/352 |
| 3,842,735 | 10/1974 | Southam et al. | 101/148 X |

FOREIGN PATENT DOCUMENTS

| | | | |
|---|---|---|---|
| 434122 | 9/1926 | Fed. Rep. of Germany | 101/148 |
| 2437583 | 5/1975 | Fed. Rep. of Germany | 101/148 |

*Primary Examiner*—Edgar S. Burr
*Assistant Examiner*—John A. Weresh
*Attorney, Agent, or Firm*—Lloyd L. Zickert

[57] ABSTRACT

An auxiliary inking roller kit for a duplicating press for improving the inking of the master cylinder which includes a pair of mounting plates between which are mounted an auxiliary ink form roller and an oscillating ink transfer roller and means for selectively positioning the auxiliary ink form roller into and out of engagement with the master cylinder, wherein the oscillating ink transfer roller is disposed between the regular lower form roller and the auxiliary form roller.

3 Claims, 3 Drawing Figures

AUXILIARY INKING ROLLER KIT FOR DUPLICATING PRESS

This invention relates in general to an auxiliary inking roller kit for a duplicating press, and more particularly to an inking roller kit that can be easily mounted on the standard duplicating press so as to greatly improve the ink distribution on the master cylinder to provide for better quality.

BACKGROUND OF THE INVENTION

A duplicating or offset printing press includes a master or plate cylinder on which is mounted the master or plate for generating an inked image and transferring it onto a blanket cylinder from which it is applied to a copy sheet fed through the machine and forced against the blanket cylinder by an impression cylinder, as is generally shown in U.S. Pat. No. 3,412,676. Ink is transferred from an ink fountain through a series of transfer rollers to a pair of form rollers in engagement with the master cylinder.

It has been known that the print quality of certain jobs has not been satisfactory from such a duplicating press.

SUMMARY OF THE INVENTION

The present invention relates to an improvement in duplicating presses and particularly to an auxiliary inking roller kit that can be economically manufactured and easily mounted on the standard duplicating press for the purpose of greatly improving the distribution of ink on the master cylinder to provide better print quality for any job run by the press and particularly those that have heretofore been unsatisfactory.

The ink roller kit of the invention includes a pair of opposed mounting plates which are mountable between the side plates of a printing press and which support an auxiliary ink form roller and an oscillating ink transfer roller. The ink transfer roller is situated between the lower form roller of the press and the auxiliary form roller to transfer ink from the lower form roller to the auxiliary form roller. It is mounted so that it may be easily placed between the mounting plates or disassembled from the mounting plates for maintenance purposes. The auxiliary form roller is mounted between the plates and connected with a lever system for selectively moving the form roller into and out of engagement with the master cylinder.

It is therefore an object of the present invention to provide an improved duplicating press by including an auxiliary form roller for distributing ink onto the master cylinder, thereby giving the machine better inking capabilities and greatly enhancing print quality.

Another object of the present invention is in the provision of an auxiliary inking roller kit for a duplicating press which can be easily mounted on a press to provide an auxiliary ink form roller for enhancing the distribution of ink onto the master cylinder.

Other objects, features and advantages of the invention will be apparent from the following detailed disclosure, taken in conjunction with the accompanying sheets of drawings, wherein like reference numerals refer to like parts.

DETAILED DESCRIPTION OF THE DRAWINGS

Figure 1:
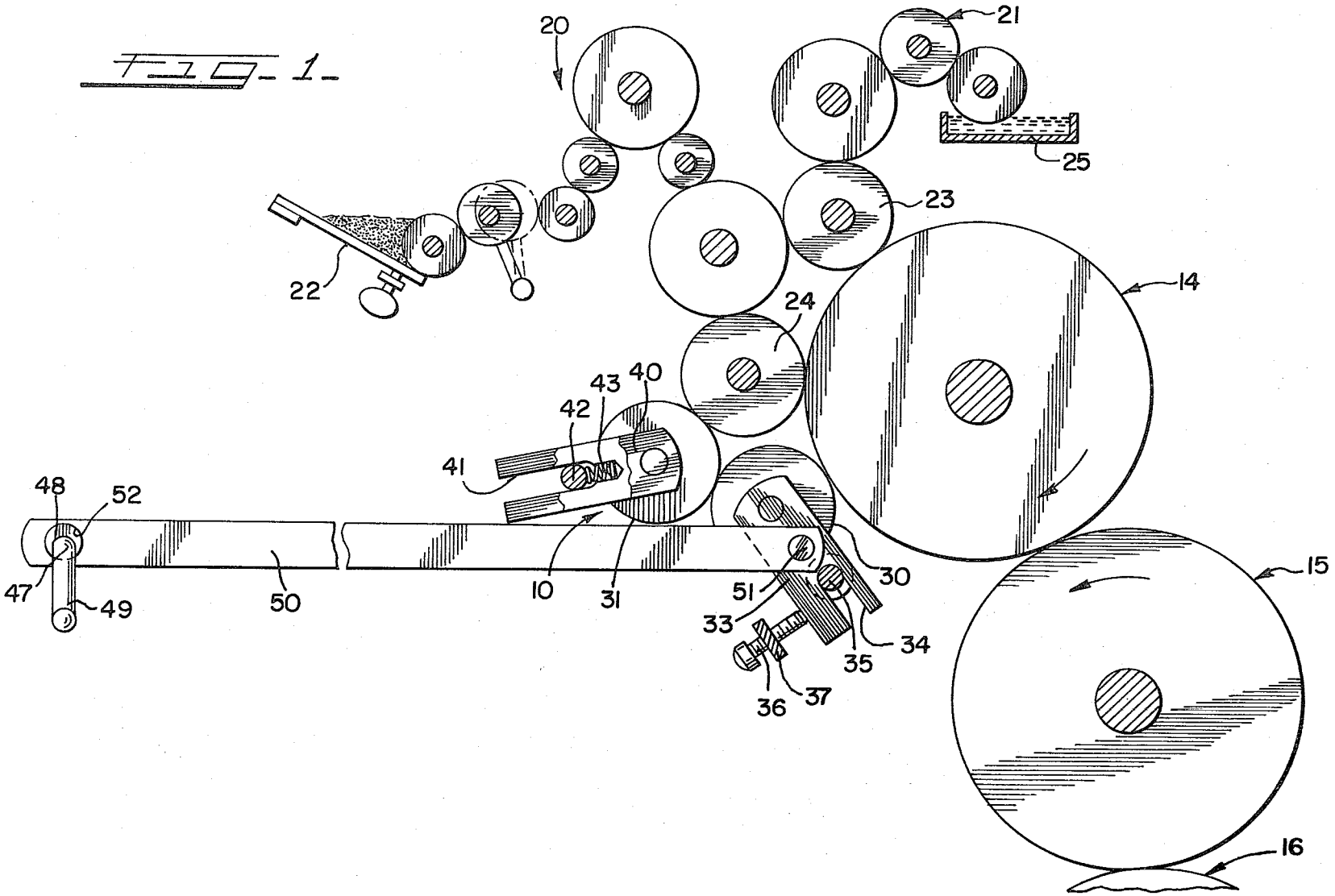
Figure 2:
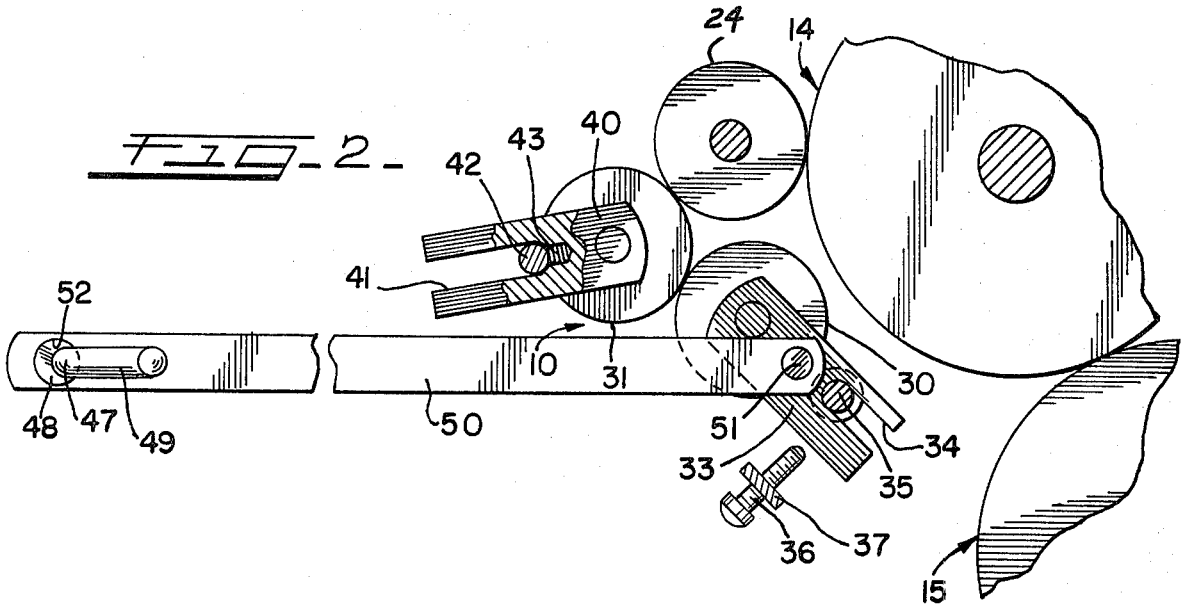
Figure 3:
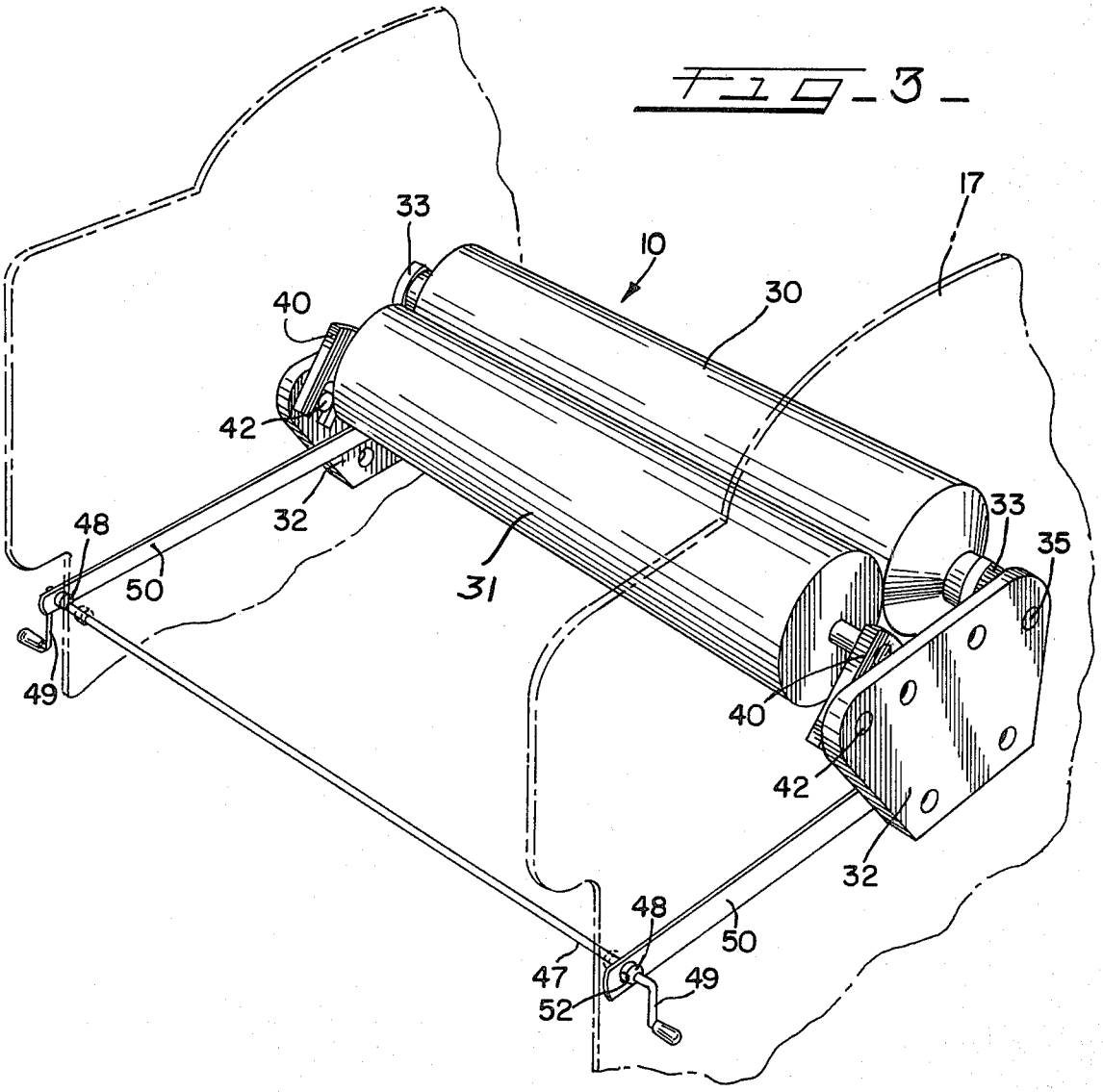

FIG. 1 is a generally diagrammatic view of a duplicating press, cylinder assembly and inking and etching system and which includes the auxiliary inking roller kit of the present invention and illustrating the auxiliary ink form roller in engagement with the master cylinder;

FIG. 2 is a diagrammatic view of the auxiliary inking roller kit in association with the master cylinder and lower form roller and illustrating the auxiliary inking roller in disengaged position from the master cylinder; and FIG. 3 is a perspective view of the ink roller kit of the present invention which illustrates the mechanism for selectively driving the auxiliary ink form roller into and out of engagement with the master cylinder.

DESCRIPTION OF THE PREFERRED EMBODIMENT

Referring now to the drawings, and particularly to FIG. 1, the auxiliary inking roller kit of the invention, generally designated as 10, is shown in associated with a duplicating press and particularly the master or plate cylinder of the press.

The duplicating press includes a framework supporting a master cylinder 14, an offset or blanket cylinder 15, and an impression cylinder 16, together with an ink and etch repellent system, all of which are supported between opposed side plates 17. While the side plates are illustrated generally and in phantom, it will be appreciated that they normally include upper and lower side plates which are not specifically illustrated for purposes of clarity.

The ink and etch repellent system includes an inking system 20 and an etch repellent system 21 of the usual type. The inking system 20 transfers ink from an ink fountain 22 through an inking roller train to upper and lower form rollers 23 and 24 that are in engagement with the master cylinder 14. The etch repellent system 21 includes a fountain 25 for the etch repellent solution and an etch repellent roller train which transfers etch repellent from the fountain to the upper form roller 23 in the usual well known fashion.

The master cylinder 14 is adapted to hold a lithographic master having an ink receptive image. The blanket cylinder 15 is adapted to be selectively engaged by the master cylinder 14 and when in engagement receives a reverse ink image from the plate mounted on the master cylinder. Copy sheets are adapted to be fed into the duplicating press between the blanket cylinder 15 and the impression cylinder 16 so that the ink image from the blanket cylinder is transferred to the copy sheets. Prior to a duplicating function, the plate on the master cylinder is coated with an ink repellent solution in the usual manner.

The auxiliary inking roller kit of the present invention includes an auxiliary ink form roller 30 and an oscillating ink transfer roller 31. These rollers are supported between a pair of opposed mounting plates 32 which are in turn suitably secured in proper position on the side plates 17 of the duplicating press at a location where the auxiliary ink form roller 30 will be disposed below the lower form roller 24 and the oscillating ink transfer roller 31 will be disposed to engage the lower ink form roller 24 and the auxiliary ink form roller 30, as seen particularly in FIG. 1. It will be appreciated that the auxiliary ink roller kit is sized so that it can be mounted between the side plates and at the lower portion of the master cylinder 14.

The auxiliary ink form roller 30 is rotatably mounted on and between a pair of opposed arms 33. As illustrated, the roller is mounted at one end of the arms which are provided with a slot 34 extending longitudinally of the arms and opening at the end of the arm opposite to where the roller is mounted. The base of the slot forms a seat against which the arm pivotally mounts on pins 35 carried by the mounting plates 32. In order to adjust the pressure setting of the form roller 30 on the master cylinder 14, an adjusting stop screw 36 is mounted on each of the mounting plates 32 and particularly to a bracket 37. Thus, each of the arms 33 also coacts with pins 34 and stop screws 36, thereby permitting pressure adjustment on both sides of the master cylinder.

The oscillating ink transfer roller 31 is provided with the standard internal oscillating mechanism which causes it to oscillate between the mounting plates when driven by the lower form roller 24. The oscillating roller 31 is rotatably mounted between and on an opposed pair of arms 40 which like the form roller arms 33 are longitudinally slotted at 41 to receive pins 42 which are fixed to the mounting plates or brackets 32. A spring 43 is mounted at the base of the slot 41 to bear against a seat in the arm and also against a pin 42 and provide a resilient mounting for the transfer roller and to continuously resiliently urge the roller 31 into engagement with the lower form roller 24 and the auxiliary form roller 30. It will be appreciated that the ink transfer roller may easily be removed for maintenance by forcing it against the pin 42 to compress the springs 43 and allow the roller to swing free of the form rollers and be removed.

A linkage and lever system is provided for selectably positioning the auxiliary form roller into and out of engagement with the master cylinder 14. This system includes an eccentric shaft 47 having eccentrics 48 mounted thereon. The shaft is suitably bearingly mounted and extends transversely of the machine. Operating levers 49 are provided at each end of the shaft for effecting rotation. If desired, knobs may be mounted on the levers 49 to facilitate the operation of the levers to rotate the eccentric shaft 47. It may be further appreciated that since the levers 49 are at opposite sides of the machine, the eccentric shaft may be operated from either side.

A pair of links 50 pivotally connected at one end at 51 to an arm 33 and provided with an eccentric bore 52 at the other end to be received on an eccentric 48 transmits motion from the eccentric to the arms for the purpose of moving the auxiliary form roller 30 into and out of engagement with the master cylinder 14. Arms 33 pivot about pins 35. It will be appreciated that the set screw stops 36 are engaged by the arms and adjusted to apply the desired pressure against the master cylinder by the form roller when the form roller is moved into engagement with the master cylinder. The stops may be individually adjusted at each end in order to provide the desired pressure at each end of the form roller with respect to the master cylinder. Thus, the auxiliary form roller may be selectively positioned into or out of engagement with the master cylinder 14.

From the foregoing, it will be appreciated that the auxiliary ink roller kit of the invention which adds an ink form roller to the inking system will provide better distribution of ink over the master on the master cylinder and thereby provide better print quality.

It will be understood that modifications and variations may be effected without departing from the scope of the novel concepts of the present invention, but it is understood that this application is to be limited only by the scope of the appended claims.

The invention is hereby claimed as follows:

1. An auxiliary inking roller kit for mounting on a duplicating press having a master cylinder rotatably mounted between opposed side plates and an ink system for applying ink to the master cylinder, said ink system including upper and lower form rollers engaging said master cylinder, an ink fountain, and a series of ink transfer rollers between said ink fountain and said form rollers, said ink roller kit comprising a pair of opposed mounting plates mountable on said side plates in fixed relation thereto, a pair of rollers, means rotatably mounting said rollers on and between said mounting plates and for movement of the axes of said pair of rollers relative to the axis of the master cylinder, one of said rollers being an auxiliary form roller for engagement with said master cylinder below said lower form roller, the other of said rollers being in engagement with said auxiliary form roller and said lower form roller to transfer ink from said lower form roller to said auxiliary form roller, and means for selectively moving the auxiliary form roller into and out of engagement with said master cylinder independently of the lower form roller so that said auxiliary form roller can be removed from contact with said master cylinder while said lower form roller remains in contact with said master cylinder.

2. The ink roller kit defined in claim 1, wherein said mounting means for each roller includes a pair of arms slotted to bear on pins extending from the mounting plates, and means resiliently mounting the transfer roller to resiliently urge it into engagement with the lower and auxiliary form rollers.

3. The ink roller kit defined in claim 2, which further includes means on said mounting plates coacting with each of the arms for said auxiliary form roller to adjust the pressure between each end of said roller and said master cylinder.

* * * * *